United States Patent [19]

Reinhall

[11] 4,003,304

[45] Jan. 18, 1977

[54] SCREW PRESS

[76] Inventor: Rolf Bertil Reinhall, 834 171st Place NE., Bellevue, Wash. 98008

[22] Filed: Apr. 14, 1975

[21] Appl. No.: 567,862

[30] Foreign Application Priority Data

Apr. 30, 1974 Sweden ..... 7405816

[52] U.S. Cl. ..... 100/117; 100/147; 100/148

[51] Int. Cl.[2] ..... B30B 9/12

[58] Field of Search ..... 100/117, 145–150

[56] References Cited

UNITED STATES PATENTS

| | | | |
|---|---|---|---|
| 647,354 | 4/1900 | Anderson | 100/147 X |
| 975,990 | 11/1910 | Overton et al. | 100/147 |
| 1,004,283 | 9/1911 | Le Docte | 100/147 |
| 2,903,960 | 9/1959 | Zies | 100/148 |
| 3,062,129 | 11/1962 | Wandel | 100/147 X |
| 3,683,796 | 8/1972 | Miner et al. | 100/147 |
| 3,760,717 | 9/1973 | DeMilt et al. | 100/147 |

*Primary Examiner*—Peter Feldman
*Attorney, Agent, or Firm*—Eric Y. Munson

[57] ABSTRACT

The invention relates to a screw press for dewatering suspended fibrous pulp. The press comprises a tubular casing with perforated wall and a screw member rotatable within the casing. The desired degree of dewatering is controlled by a throttling member adjustable so as to generate a predetermined counter-pressure against the pulp advanced by the screw member. It rather often occurs that the pressure produced in the press becomes so high that the rotation of the screw member is stopped which means total stop of the operation of the press. The invention provides means adapted automatically to avoid such undesired stop in operation by relieving the press from internal pressure exceeding a predetermined, adjustable value.

4 Claims, 2 Drawing Figures

10
12
20
14
15
18
16
34
32
38
42
44
43
40
46
48
II
28
30
24
22
26
36

SCREW PRESS

BACKGROUND OF THE INVENTION

This invention relates to a screw press.

More particularly, this invention relates to a screw press for dewatering suspended fibrous pulp, the press being of the type comprising a perforated tubular casing and a rotatable screw member housed therein, said casing having an inlet and an outlet for the pulp, said outlet being devised to cooperate with a throttling member for generating a counter-pressure on advance feeding of the pulp in the casing. The throttling member may have the shape of a conical valve member which may be under the action of a pressure-producing member, such as a hydraulic servomotor, so as to cause the counter-pressure acting on the pulp to become adjustable and thereby adapted to impart to the pulp desired dry content. The throttling member producing the counter-pressure may be resilient so as gradually to open on start of the press until the predetermined dewatering pressure has been built up in the press.

THE PRIOR ART

In known screw presses of the type defined above it occurred rather often that the pressure in the press was increased to a too high value due to phenomenon that the pulp became packed in the interspaces between the threads of the screw member and the casing which resulted in that the screw member was jammed so that its rotation was stopped. With the throttling member mentioned above such a stop cannot be overcome.

SUMMARY OF THE INVENTION

Therefore, one main object of the invention is to provide means for preventing generation of such overpressure in the press due to excess compression of the pulp within the press casing, with resultant stoppage of operation of the press.

Another object of the invention is to provide means for automatically relieving the press from excess pressure upon reaching a predetermined value of the pressure due to compression of the pulp within the press casing between the threads of the screw member.

MAIN FEATURES AND ADVANTAGES OF THE INVENTION

According to a main feature of the invention a portion of the casing adjacent the outlet is divided axially into flaps mounted to move in a direction away from the screw member, said flaps being actuated by relief members which open the flaps when pressure exerted by the pulp on said flaps exceed a predetermined maximum.

According to an especially advantageous embodiment of the invention the flaps are shaped as semi-tubular elements which together encase the screw member and have their ends remote from the outlet pivotably attached to the casing.

It is easily understood that in operation of the press said semi-tubular elements are exposed to a pressure from the pulp acting radially, whereas the throttling or counter-pressure generating member exerts mainly an axial pressure on the pulp, which pressure, even if it should be relieved is, not capable of loosening the pulp when the latter temporarily is excessively compressed in the screw member. According to the invention, the internal pressure in the screw press is prevented from increasing to such a degree that the press is stopped by jamming of the screw member.

DETAILED DESCRIPTION OF AN EMBODIMENT OF THE INVENTION

Figures 1, 2:
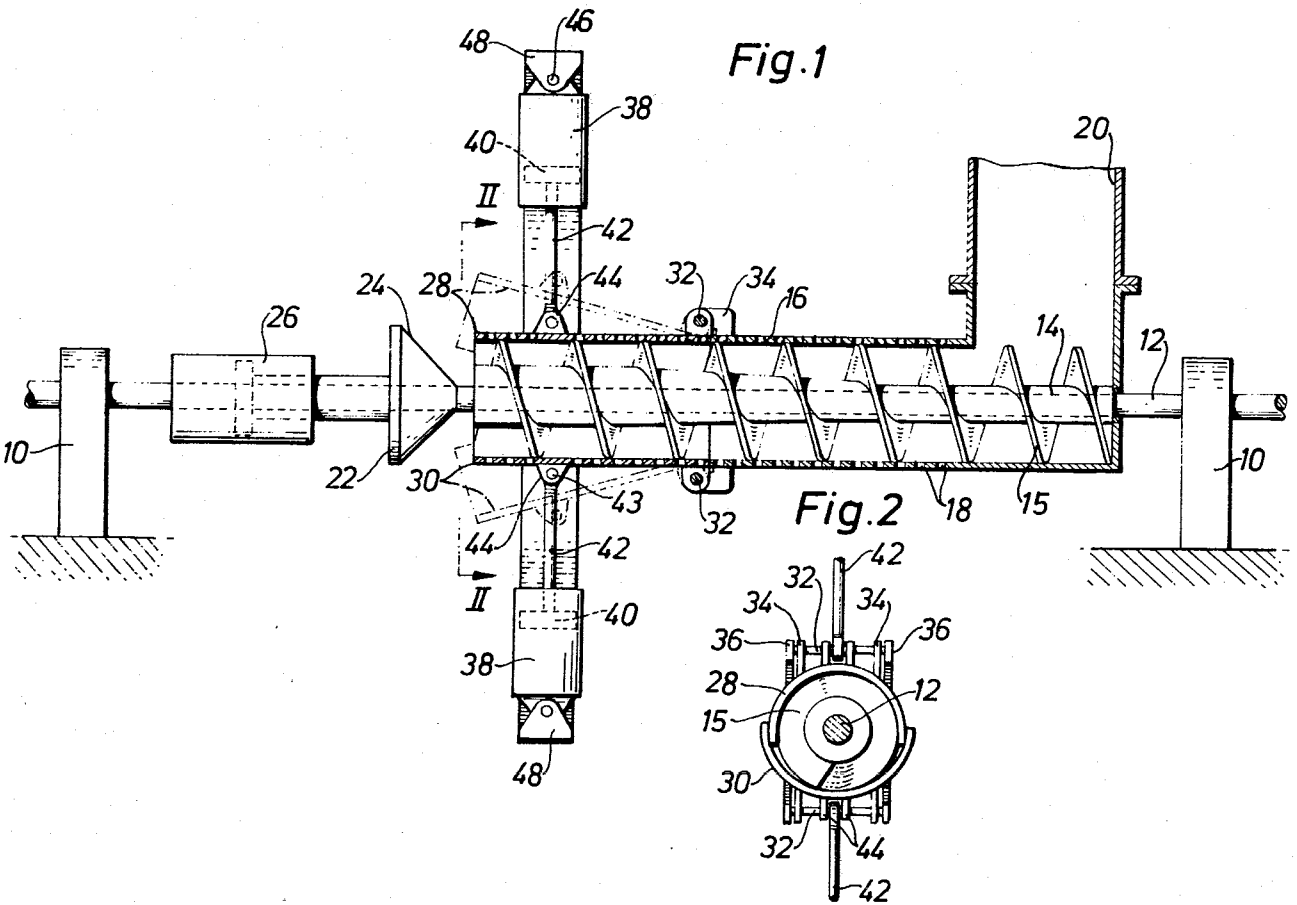
FIG. 1 is a vertical longitudinal, sectional view of a screw press embodying the features of the invention.
FIG. 2 is an end view taken along the line II—II of FIG. 1.

Referring now to the drawing, reference numeral 10 denotes two stationary bearing brackets, supporting together a shaft 12 which is driven by a motor not shown. Over a portion of the length of the shaft a screw member 14 is mounted, the thread 15 of which is enclosed by a casing 16 formed with perforations 18. The casing 16 has cylindrical tube shape and conforms to the outer peripheral contour of the thread 15. The fibre pulp suspended in water is introduced into the press through an inlet channel 20 at one end of the press and the dewatered pulp is discharged at the opposite end of the press. At the latter end a throttling or counter-pressure member, such as a valve 22 with conical surface 24, is arranged to generate the counter-pressure required for the dewatering operation. The valve is located on the shaft 12 and axially displaceable thereon by means of an adjusting member 26. In this connection, the valve may be automatically displaceable so that on starting of the press it will bear against the outlet opening of the casing or leave a small clearance only to permit advancement of the pulp, and as the dewatering pressure increases the valve will open to a predetermined position.

According to the invention, the casing over portion of its length adjacent the outlet is constituted by two semi-tubular flaps 28, 30, which together encase the screw 14 while overlapping one another as is evident from FIG. 2 so that good sealing effect is obtained along the two longitudinal joints between the halves. Each flap is mounted pivotably about its transversal journal 32 carried by ears 36 fixed on the stationary casing 16. Rigidly secured on the tubular parts are ears 34 which constitute bearings for the shaft 32. Each of the flaps 28, 30 is pivotable about its journal 32 and is actuated by its relief member. Preferably said member has the shape of a hydraulic servomotor composed of a cylinder 38 and a piston 40 slidable within said cylinder and connected to a bar 42 which by means of a pin 43 is mounted in bearings formed by ears 44 on the flaps 28, 30. The cylinders 38 may in turn be pivotable about pins 43 supported by stationary brackets 48.

In operation of the press, the pulp suspension is fed in through the inlet 20. During passage through the press, a gradual dewatering is effected, the water escaping through the perforations 18. The counter-pressure member 22 adjusts itself to such an opening or gap towards the outlet that desired dry content is imported to the pulp. If such compressed packing of the pulp should occur in the press that the progressive advancement of the pulp tends to become stopped, the radially outwardly directed pressure on the flaps 28, 30 is increased, and when a predetermined value of said pressure is reached, the servomotors yield so as to permit the flaps to swing outwards into the position indicated by dashes in FIG. 1. This relieves pressure so as to allow the compressed pulp to exit from the press, whereafter the flaps return to their closed or encasing position and the press will continue normal operation.

While one more or less specific embodiment of the invention has been shown or described, it is to be understood that this is for purpose of illustration only, and that the invention is not to be limited thereby, but its scope is to be determined by the appended claims.

What is claimed is:

1. A continuous flow dewatering press for fiber pulp suspension comprising:

a. an inlet channel for receiving the pulp to be dewatered;

b. a tubular compression casing having an inlet connected to said inlet channel and an outlet at the opposite end thereof;

c. means for advancing the fiber pulp from the inlet end to the outlet while progressively compressing and dewatering the same;

d. a plurality of perforations in the walls of said tubular casing to permit water to drain therefrom as the fiber pulp is advanced therein, e. adjustable throttling means at the outlet end of said casing for controlling the rate of liquid discharge and to maintain a predetermined pulp concentration in said pulp suspension within said casing;

f. flaps forming a substantially aligned extension of said tubular casing adjacent the outlet thereof and normally enclosing said pulp advancing means thereof;

g. said flaps being hinged to said casing to swing outwardly about an axis perpendicular to the axis of said tubular casing to provide a flared mouth facing said throttling means, and h. means for exerting a predetermined maximum yielding pressure on said flaps to maintain said flaps substantially aligned with the unhinged portion of said casing until the pressure produced by the compression of the fiber pulp exceeds said predetermined maximum.

2. A dewatering press according to claim 1 in which said means for advancing and compressing the fiber pulp comprises a conveyor screw extending from said inlet end to said outlet.

3. A dewatering press according to claim 2, in which said flaps comprise semi-tubular elements.

4. A dewatering press according to claim 3, in which said semi-tubular elements overlap along their confronting longitudinal edges.

* * * * *